US011583054B1

(12) United States Patent
Kafri

(10) Patent No.: US 11,583,054 B1
(45) Date of Patent: Feb. 21, 2023

(54) HAIRCUTTING TEMPLATE

(71) Applicant: Jehad M. Kafri, South Riding, VA (US)

(72) Inventor: Jehad M. Kafri, South Riding, VA (US)

( * ) Notice: Subject to any disclaimer, the term of this patent is extended or adjusted under 35 U.S.C. 154(b) by 0 days.

(21) Appl. No.: 17/860,376

(22) Filed: Jul. 8, 2022

(51) Int. Cl.
*A45D 24/36* (2006.01)

(52) U.S. Cl.
CPC ..... *A45D 24/36* (2013.01)

(58) Field of Classification Search
CPC ..... A45D 24/36; A45D 8/36; A45D 19/016; A41D 20/10
See application file for complete search history.

(56) References Cited

U.S. PATENT DOCUMENTS 1,091,372 A * 3/1914 Mickelson ..... A45D 24/36 132/214
1,585,088 A * 5/1926 Delmon ..... A45D 24/36 132/214
2,698,018 A * 12/1954 Post ..... A45D 24/36 132/141
2,799,973 A 11/1955 Fox, Sr.
2,808,840 A 10/1957 De Santis
2,917,055 A * 12/1959 Fouche ..... A45D 24/36 30/201
2,919,702 A 1/1960 Olivo
3,180,341 A * 4/1965 Dumont ..... A45D 24/36 132/213
3,202,158 A 8/1965 Dumont
3,935,870 A 2/1976 Wall
4,206,773 A * 6/1980 DeHerrera ..... A45D 24/36 132/213
4,867,184 A 9/1989 Davis
5,494,057 A 2/1996 Gianfrancesco
D814,113 S 3/2018 Yeheskel

* cited by examiner

*Primary Examiner* — Cris L. Rodriguez
*Assistant Examiner* — Brianne E Kalach
(74) *Attorney, Agent, or Firm* — Cramer Patent & Design, PLLC; Aaron R. Cramer

(57) ABSTRACT

A haircutting template is a plastic headpiece having a plurality of upper blade rows and a plurality of perpendicularly disposed lower blade rows in the shape of a head. The peripheral edge of the device has the shape of a common hairline. The template is capable of being removably secured about the head of a user by means of an adjustable strap.

18 Claims, 7 Drawing Sheets

HAIRCUTTING TEMPLATE

RELATED APPLICATIONS

None.

FIELD OF THE INVENTION

The present invention relates generally to a template for cutting hair.

BACKGROUND OF THE INVENTION

People all over the world routinely go to a hair salon or barber for a haircut. While some people may be happy to do so, many would prefer to avoid the trip and expense of getting a professional haircut. This is almost certainly true for people who have a haircut that is not complicated.

In order to facilitate untrained users to cut their own hair there have been many devices offered for sale that promote an easy do it yourself haircutting solution. However, often times these products are not affordable or as easy to use as would first seem. Therefore, a need exists for a device which affords a user a safe and cost-effective way to cut his or her own hair. The development of the haircutting template fulfills this need.

SUMMARY OF THE INVENTION

It is therefore an object of the present invention to provide haircutting template that has a band configured for disposal about a head of a user, a band horizontal portion, and a front strap, a first guide vertically adjusted to the band, a second guide first portion horizontally adjusted to the band and conformed to fully cover over and conform to a first portion of the back of the head of the user and to terminate at the bottom of the back of the head of the user farther down from the termination of a first back portion of the hair, a second guide second portion horizontally adjusted to the band and conformed to fully cover over and conform to a second portion of the back of the head of the user and to terminate at the bottom of the back of the head of the user farther down from the termination of a second back portion of the hair, a third guide first portion horizontally adjusted to the band and conformed to fully cover over and conform to a first side of the head of the user and to terminate at the bottom of the first side of the head of the user farther down from the termination of a first side of the hair, and a third guide second portion horizontally adjusted to the band and conformed to fully cover over and generally conform to a second side of the head of the user and to terminate at the bottom of the second side of the head of the user farther down from the termination of a second side of the hair. The band includes a band vertical portion.

The band is adjustable to fit a plurality of different sized heads of the user. The first guide is conformed to fully cover over and generally conform to the shape of a top of the head of the user and to terminate on a forehead of the user either directly on the front strap or over farther downward relative to the front strap. The first guide includes a plurality of tines equidistantly spaced apart from each other and extending away from a first guide rail parallel to each other to enable portions of a plurality of hair of the top of the head of the user to extend through to aid styling thereof. The second guide first portion includes a plurality of tines equidistantly spaced apart from each other and extending away from a second guide first rail parallel to each other to enable portions of the first back portion of the hair of the back of the head of the user to extend through to aid the styling thereof. The second guide second portion includes a plurality of tines equidistantly spaced apart from each other and extending away from a second guide second rail parallel to each other to enable portions of the second back portion of the hair of the back of the head of the user to extend through to aid the styling thereof. The third guide first portion includes a plurality of tines equidistantly spaced apart from each other and extending away from a third guide first rail to enable portions of the first side of the hair of the first side of the head of the user to extend through to aid the styling thereof. The third guide second portion includes a plurality of tines equidistantly spaced apart from each other and extending away from a third guide second rail to enable portions of the second side of the hair of the second side of the head of the user to extend through to aid the styling thereof.

The band vertical portion may have an inner side shaped to generally conform to the back of the head of the user. The band horizontal portion may include a front edge that coextensively extends horizontally away from a bottom edge of the band vertical portion. The band horizontal portion may extend past a plurality of hair from the back of the head of the user to permit styling thereof. The band may be made out of a material from the group consisting of resilient, washable, and stainless subjected to heat and one or more chemicals associated with haircare. The front strap may conformably secure the haircutting template about the forehead of the user in order to separate the haircutting template into a plurality of upper areas to aid in styling the top of the head of the user from the lower areas to aid in styling the back of the head of the user, the first side of the head of the user, and the second side of the head of the user. The front strap may include a plurality of strap fasteners located adjacent to a pair of distal ends thereof. The strap fasteners may be removably attached to a plurality of complementary fasteners located on a plurality of outer surfaces of the distal ends of the band vertical portion. The strap fasteners may be selected from the group consisting of a plurality of permanent strap fasteners, a plurality of like rivets, a plurality of removable strap fasteners, a plurality of snaps, or a plurality of magnets. The front strap may be elastic or rigid to provide manual adjustment to determine conformity to the forehead of the user.

The front strap may include an adjustment mechanism. The front strap may be affixed or partially encased within the band vertical portion. The first guide rail may have a shape and length to enable the inner side thereof to nest against the inner surface of the band vertical portion when removably and adjustably attached thereto. The first guide rail may be at least one upper extender, each formed on an inner surface thereof and extending either partially or coextensively with a width thereof. The second guide first rail may enable the upper side thereof to nest against a first back portion of the lower surface of the band horizontal portion when removably and adjustably attached thereto. The second guide first rail may have a shape and length to enable the upper side thereof to nest against the first back portion of the lower surface of the band horizontal portion when removably and adjustably attached thereto. The second guide second rail may have a shape and length to enable the upper side thereof to nest against a second back portion of the lower surface of the band horizontal portion when removably and adjustably attached thereto. The third guide first rail may have a shape and length to enable the upper side thereof to nest against a first side of the lower surface of the band horizontal portion when removably and adjustably attached thereto.

The third guide second rail may have to enable the upper side thereof to nest against a second side of the lower surface of the band horizontal portion when removably and adjustably attached thereto. The surface facing the upper surfaces of the second guide first rail, the second guide second rail, the third guide first rail, and the third guide second rail includes a plurality of lower tracks, may each be formed therewithin and extends either partially or coextensively with the width thereof.

BRIEF DESCRIPTION OF THE DRAWINGS

These and other features, aspects, and advantages of the present disclosure will become better understood with regard to the following description, appended claims, and accompanying drawings where:

DESCRIPTIVE KEY

Figure 1:
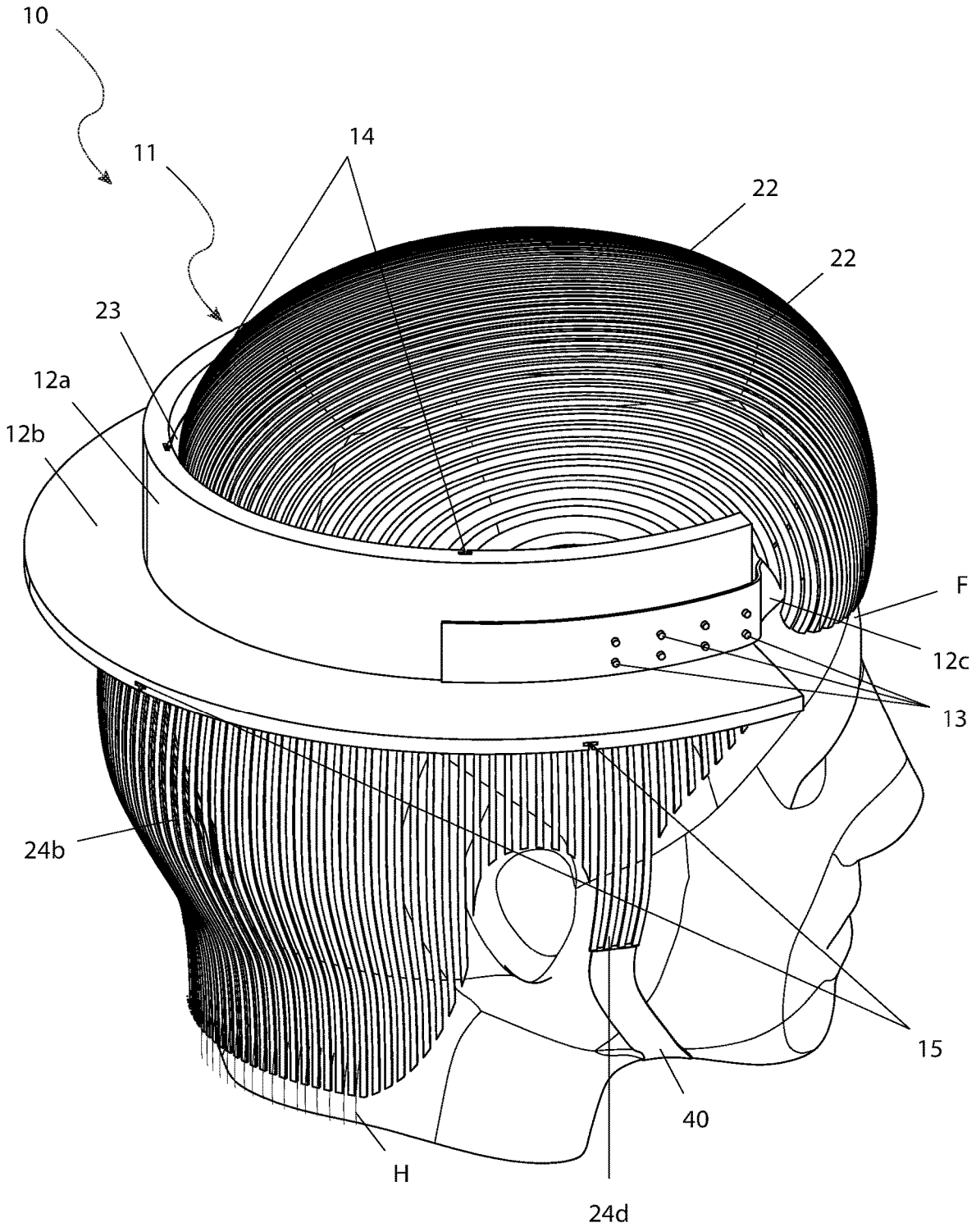
FIG. 1 is an environmental perspective view of a haircutting template according to an embodiment of this disclosure.
Figure 2:
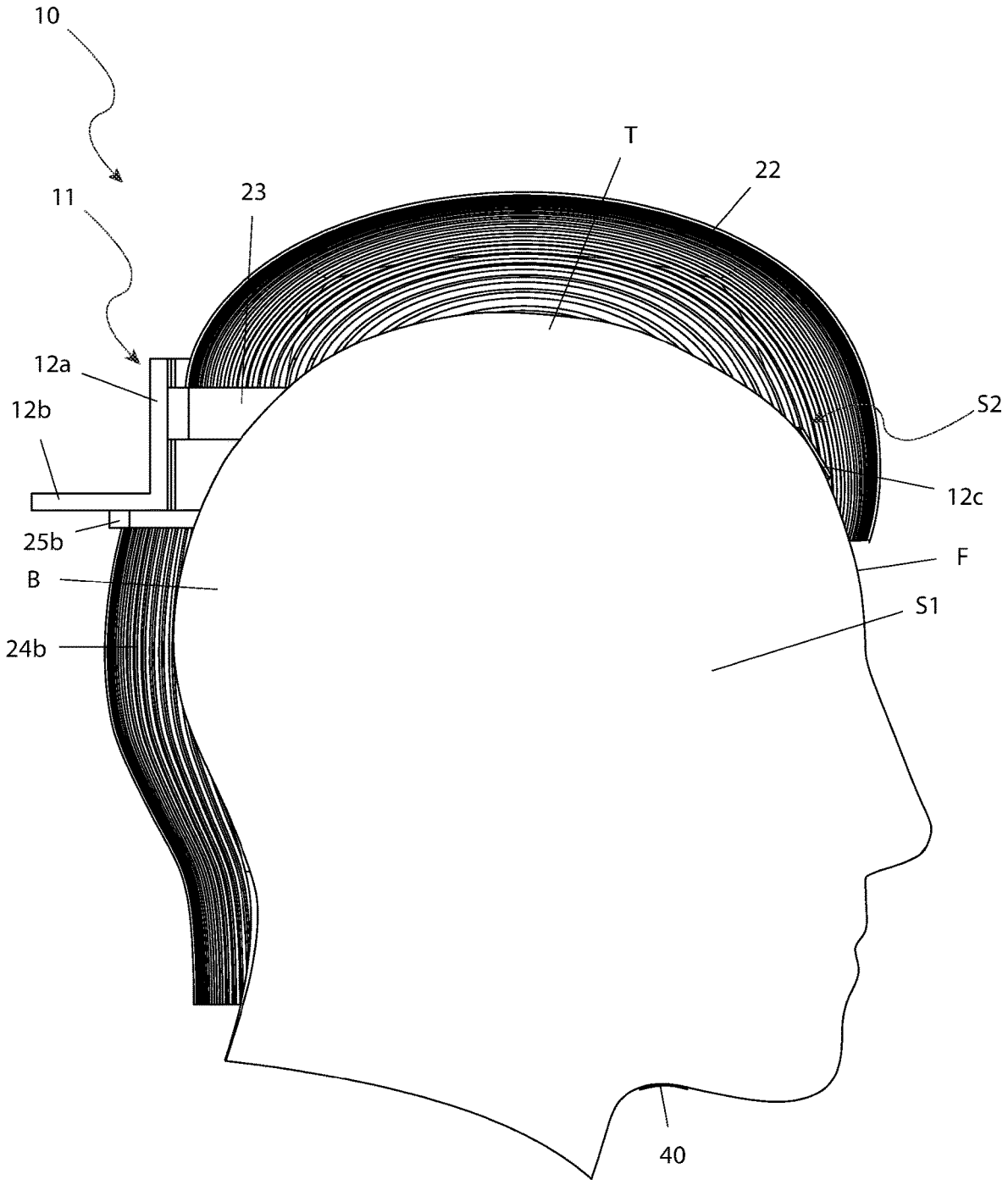
FIG. 2 is a side environmental view of the template according to an embodiment of this disclosure.
Figure 3:
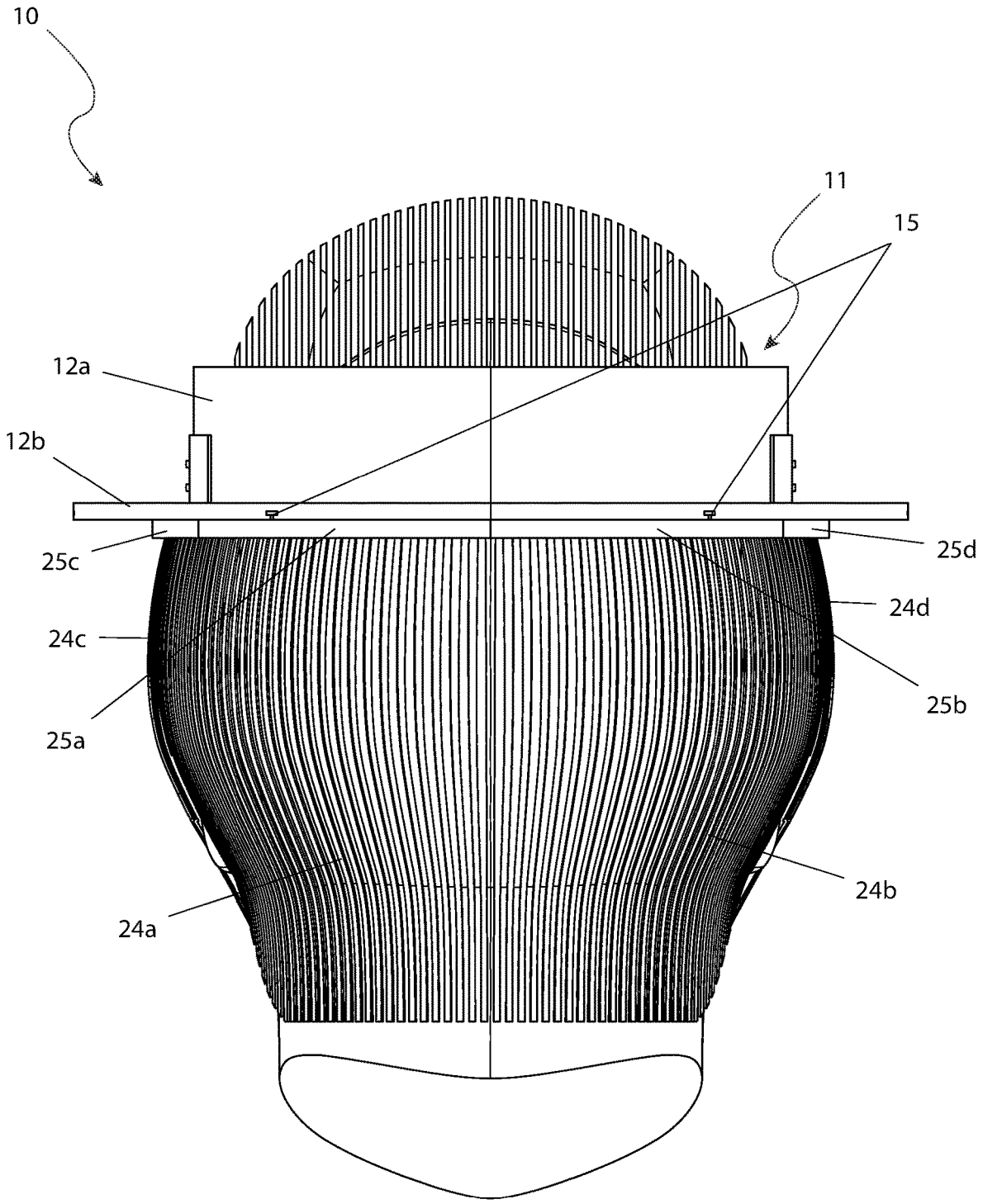
FIG. 3 is a rear environmental view of the template according to an embodiment of this disclosure.
Figure 4:
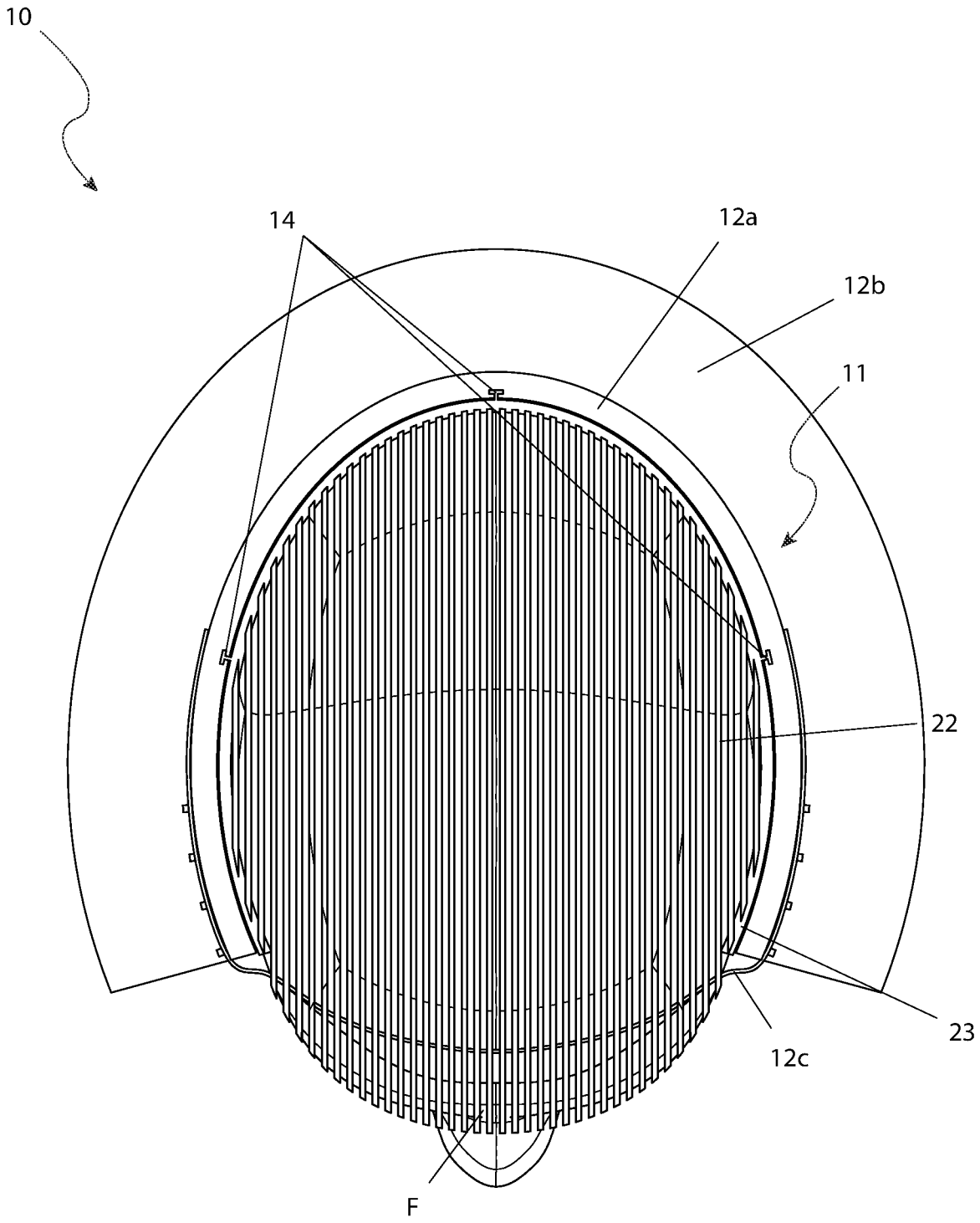
FIG. 4 is a top environmental view of the template according to an embodiment of this disclosure.
Figure 5:
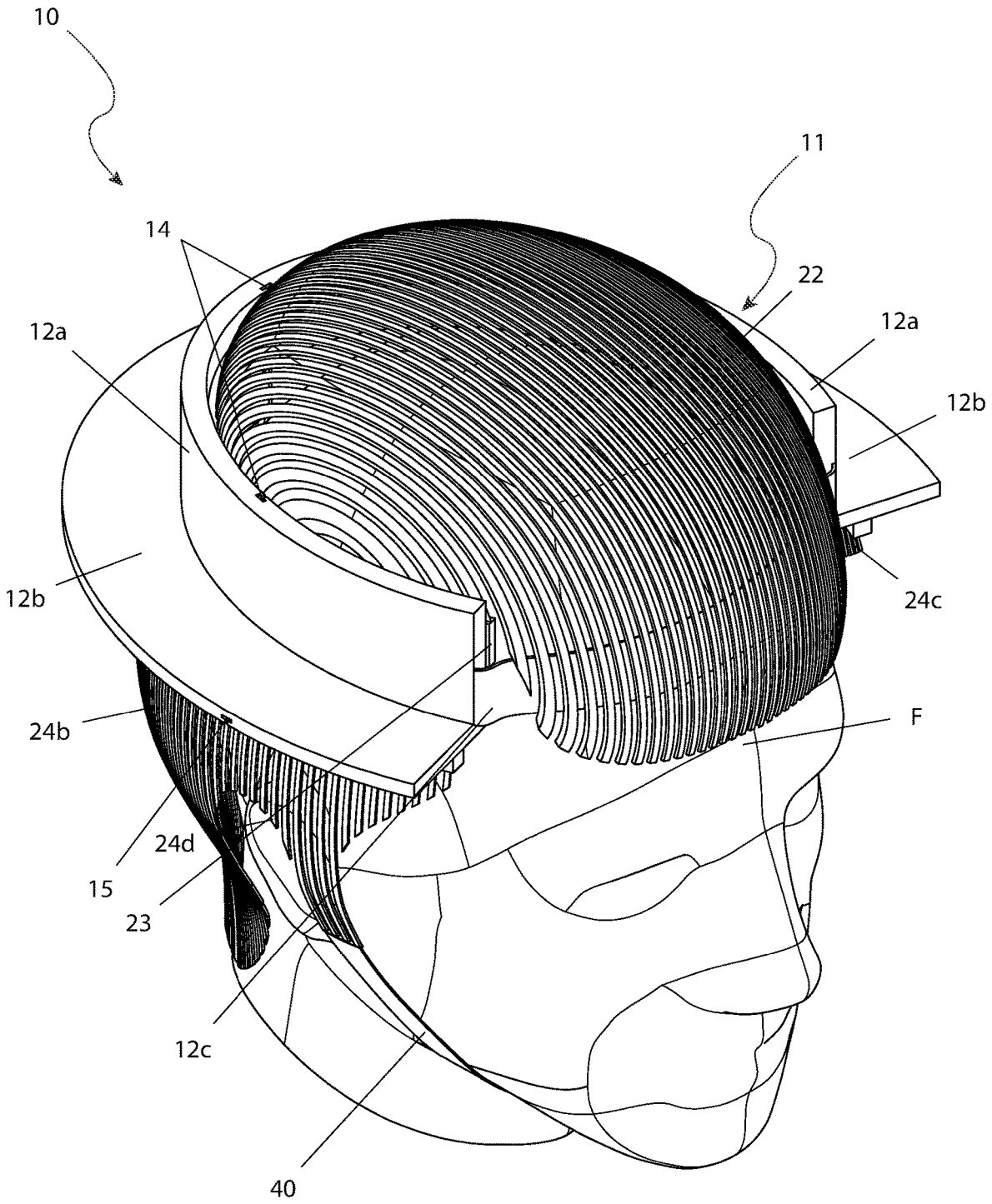
FIG. 5 is a top front perspective environmental view of the template according to another embodiment of this disclosure.
Figure 6:
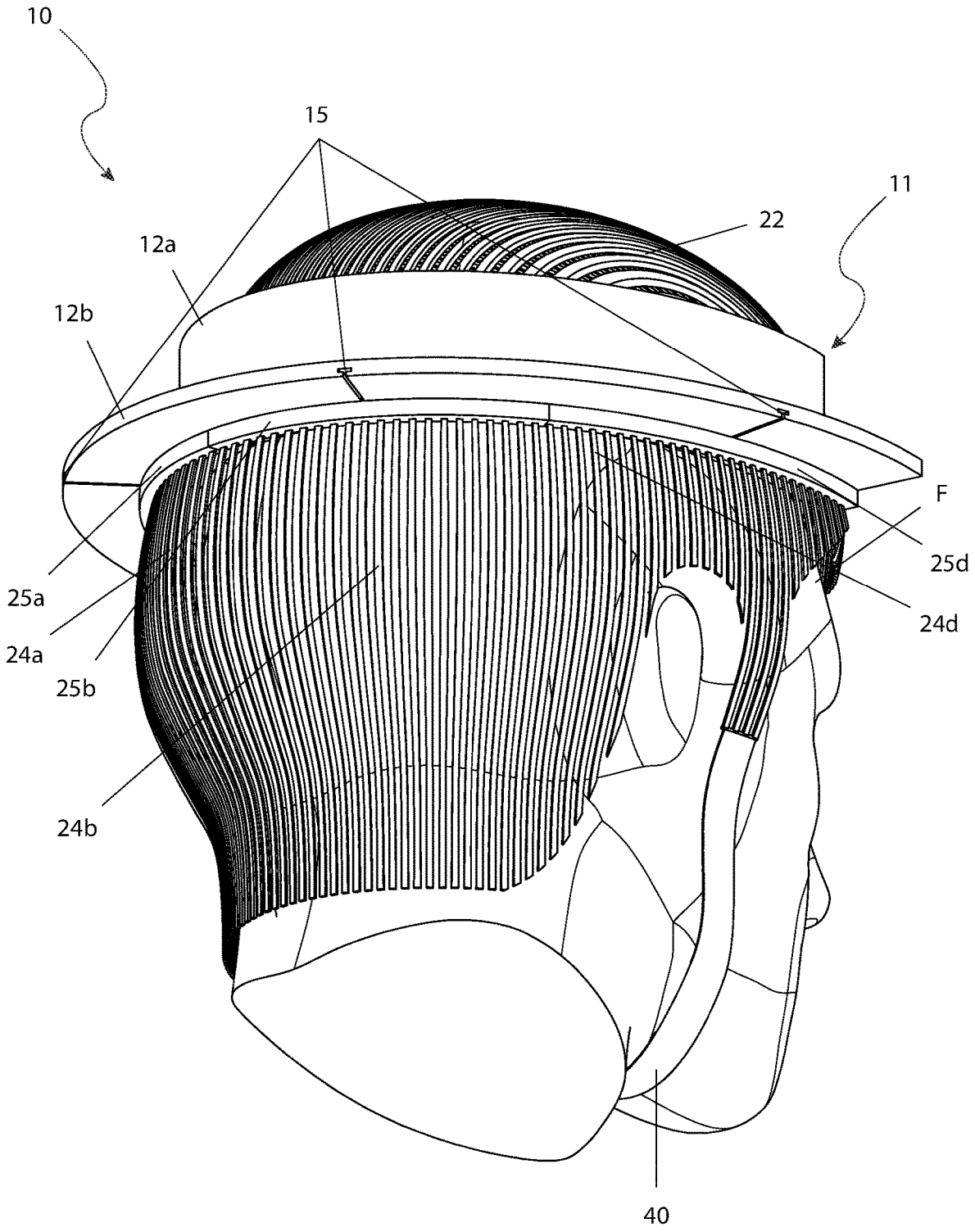
FIG. 6 is a rear bottom perspective environmental side view of the template according to another embodiment of this disclosure.

10 haircutting template
12*a* band vertical portion
12*b* band horizontal portion
12*c* front strap
13 strap fastener
14 upper track
15 lower track
17 upper extender
18 lower extender
22 first guide
23 first guide rail
24*a* second guide first portion
24*b* second guide second portion
24*c* third guide first portion
24*d* third guide second portion
25*a* second guide first rail
25*b* second guide second rail
25*c* third guide first rail
25*d* third guide second rail
40 chin strap
H hair
B back of head
F forehead
T top of head
S1 first side of head
S2 second side of head

DETAILED DESCRIPTION

The following disclosure is provided to describe various embodiments of a haircutting template 10 configured to assist to professionally cut hair H without assistance from others. In addition, the template 10 can be used by someone to cut another's hair H or to cut their own hair H. The template 10 will determine the preset hair H length at different sides of the head S1, S2 of a user. The template 10 will have different sizes, adjustments, or connections to allow different head B, F, T, S1, S2 sizes to fit inside the template 10. The template 10 may be configured to look like a curved comb-shaped device. The template 10 will include of horizontal lines on the top of the head T of a user and vertical lines at the sides S1, S2 of a user and the back of the head B of a user.

Skilled artisans will appreciate additional embodiments and uses of the present invention that extend beyond the examples of this disclosure. Terms included by any claim that may be presented in any yet-to-be-filed non-provisional patent application are to be interpreted as defined within this disclosure. Singular forms should be read to contemplate and disclose plural alternatives. Similarly, plural forms should be read to contemplate and disclose singular alternatives. Conjunctions should be read as inclusive except where stated otherwise.

Expressions such as "at least one (1) of A, B, and C" should be read to permit any of A, B, or C singularly or in combination with the remaining elements. Additionally, such groups may include multiple instances of one (1) or more element in that group, which may be included with other elements of the group. All numbers, measurements, and values are given as approximations unless expressly stated otherwise.

Various aspects of the present disclosure will now be described in detail, without limitation. Skilled readers should not view the inclusion of any alternative labels as limiting in any way. Referring now to FIGS. 1-7, an illustrative haircutting template 10 that can be used to cut hair H is described herein. Haircutting template 10 can be used to cut one's own hair H or to cut someone else's hair H without assistance.

The template 10 includes a band 11 configured for disposal about a head B, T, S1, S2 of a user and adjustable to fit different sized heads B, F, T, S1, S2 of a user. The band 11 further comprises a band vertical portion 12*a*, a band horizontal portion 12*b*, and a front strap 12*c*. The band vertical portion 12*a* and band horizontal portion 12*b* is preferably a unitary construction fabricated out of a resilient, washable, and stainless material capable of being subjected to heat and chemicals typically associated with haircare. The band vertical portion 12*a* has a height of approximately one to two inches (1-2 in.) and has an inner side shaped to generally conform to a back of the head B of a user. The band horizontal portion 12*b* has a front edge that coextensively extends horizontally away from a bottom edge of the band vertical portion 12*a*. The opposing outer edge of the band horizontal portion 12*b* terminates at approximately 1-2 inches (1-2 in.) away from the band vertical portion 12*a*. The band horizontal portion 12*b* should preferably extend past the hair Hof the back of the head B of a user so as to permit styling thereof. The band horizontal portion 12*b* may extend perpendicularly from the band vertical portion 12*a*.

A front strap conformably secures the template 10 about the forehead F of a user in order to separate the template 10 into upper areas to aid in styling the top of the head T of a user from the lower areas to aid in styling the back of the head B of a user, the first side of the head S1 of a user, and the second side of the head S2 of a user. In a first embodiment, such as that illustrated in FIGS. 1-4, the front strap 12*c* has a plurality of strap fasteners 13 located adjacent to the distal ends thereof. These strap fasteners 13 are capable of removable attachment to complementary fasteners located on the outer surfaces of the distal ends of the band vertical portion 12*a*. Such strap fasteners 13 can be permanent like rivets or removable such as snaps or magnets. The front strap 12*c* may be elastic or rigid and the amount of strap fasteners 13 to provide manual adjustment may determine conformity to the forehead F of a user. There may also be an adjustment mechanism on the front strap 12*c*. As depicted more closely in FIGS. 5 and 6, a second embodiment provides for where the front strap 12*c* is affixed or partially encased within similar locations of the band vertical portion 12*a* as mentioned in the first embodiment.

A first guide 22 is vertically adjustable to the band 11 and conformed to preferably fully cover over and generally conform to the shape of the top of the head T of a user and to terminate on the forehead F of a user either directly on the front strap 12*c* or over farther downward relative to the front strap 12*c*. The first guide 22 comprises a plurality of tines preferably equidistantly spaced apart from each other and extending away from a first guide rail 23 parallel to each other, although other patterns are envisioned. The spacing of the tines is configured to enable portions of the hair H of the top of the head T of a user to extend through to aid the styling thereof. The first guide rail 23 has a shape and length to enable the inner side thereof to nest against the inner surface of the band vertical portion 12*a* when removably and adjustably attached thereto. In the exemplary embodiment, the plurality of tines is a parallel back-to-front direction.

Figure 7:
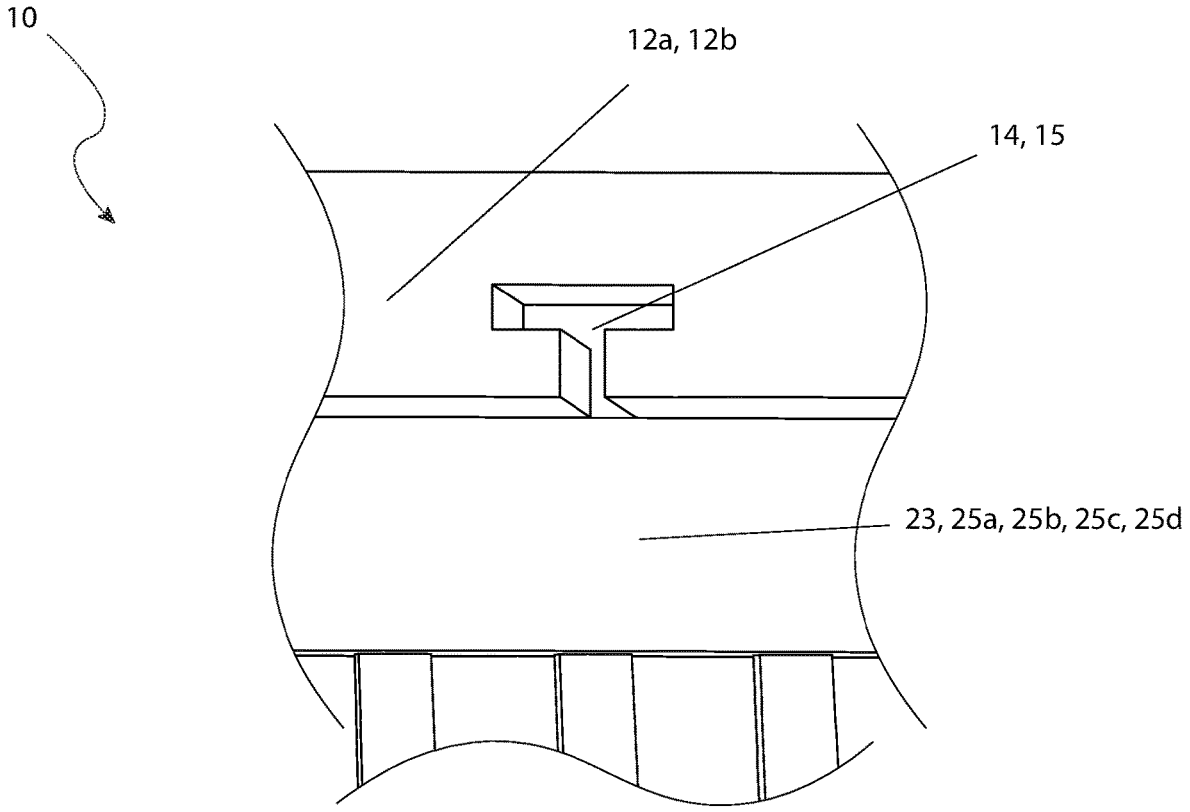
FIG. 7 shows the upper and lower adjustable track for the template, according to an embodiment of this disclosure.
Figure 8:
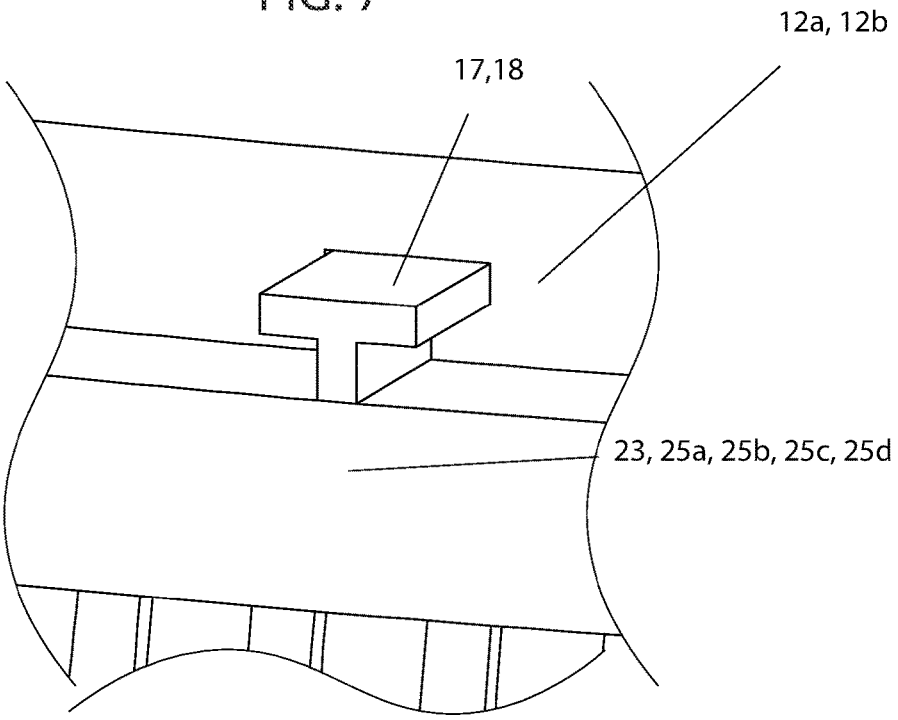
FIG. 8 shows an upper and lower extender partially inserted into a respective upper and lower adjustable track for the template, according to an embodiment of this disclosure.

Looking more closely to FIGS. 7 and 8, there is illustrated a more detailed view of the removable connection of the first guide 22 to the band 11. The first guide rail 23 has at least one (1) upper extender 17, each formed on an inner surface thereof (i.e., the surface facing the inner surface of the band vertical portion 12*a*) and extending either partially or coextensively with the width thereof. On the inner surface of the band vertical portion 12*a* (i.e., the surface facing the inner surface of the first guide rail 23) is a plurality of upper tracks 14, each formed therewithin and extends either partially or coextensively with the width thereof. The number of the upper tracks 14 shall equal or exceed the number of the upper extenders 17. The shape of the upper tracks 14 shall match the shape of the upper extenders 17 so that the upper extenders 17, and thus the first guide 22 itself, can be vertically motioned therewithin to enable vertical adjustment to the band 11 via the band vertical portion 12*a*.

It is also envisioned that other embodiments may fall under the scope of the present invention, such as embodiments where the upper tracks 14 are on the first guide 22 and the upper extenders 17 are on the band vertical portion 12*a*. In the exemplary embodiment, the number of upper tracks 14 and upper extenders 17 is three (3). It is appreciated that there could be more than one (1) upper track 14/upper extender 17 pairs. In some embodiments, the first guides 22 may be integrally connected with the band 11 or otherwise removably connected via a friction fit, pressure fit, mating engagement, dovetail connection, clips, barbs, tongue-in-groove, threaded, magnetic and/or key/keyslot. It is preferred that the final resting place of a desired vertical position of the first guide 22 relative to the band 11 is secure. Resting stops to further enhance the security of the desired vertical position can be envisioned to be used with the present invention.

A second guide first portion 24*a* is horizontally adjustable to the band 11 and conformed to preferably fully cover over and generally conform to the shape of a first portion of the back of the head B of a user and to terminate at the bottom of the back of the head B of a user preferably farther down from the termination of a first back portion of the hair H. The first back portion of the hair H is illustrated herein as the back left side. The second guide first portion 24*a* comprises a plurality of tines preferably equidistantly spaced apart from each other and extending away from a second guide first rail 25*a* parallel to each other, although other patterns are envisioned. The spacing of the tines is configured to enable portions of the first back portion of the hair H of the back of the head B of a user to extend through to aid the styling thereof. The second guide first rail 25*a* has a shape and length to enable the upper side thereof to nest against a first back portion of the lower surface of the band horizontal portion 12*b* when removably and adjustably attached thereto. In the exemplary embodiment, the plurality of tines is a parallel top-to-bottom direction.

A second guide second portion 24*b* is horizontally adjustable to the band 11 and conformed to preferably fully cover over and generally conform to the shape of a second portion of the back of the head B of a user and to terminate at the bottom of the back of the head B of a user preferably farther down from the termination of a second back portion of the hair H. The second back portion of the hair H is illustrated herein as the back right side. The second guide second portion 24*b* comprises a plurality of tines preferably equidistantly spaced apart from each other and extending away from a second guide second rail 25*b* parallel to each other, although other patterns are envisioned. The spacing of the tines is configured to enable portions of the second back portion of the hair H of the back of the head B of a user to extend through to aid the styling thereof. The second guide second rail 25*b* has a shape and length to enable the upper side thereof to nest against a second back portion of the lower surface of the band horizontal portion 12*b* when removably and adjustably attached thereto. In the exemplary embodiment, the plurality of tines is a parallel top-to-bottom direction.

A third guide first portion 24*c* is horizontally adjustable to the band 11 and conformed to preferably fully cover over and generally conform to the shape of a first side of the head S1 of a user and to terminate at the bottom of the first side of the head S1 of a user preferably farther down from the termination of a first side of the hair H. The first side of the hair H is illustrated herein as the left side. The third guide first portion 24*c* comprises a plurality of tines preferably equidistantly spaced apart from each other and extending away from a third guide first rail 25*c* parallel to each other, although other patterns are envisioned. The spacing of the tines is configured to enable portions of the first side of the hair H of the first side of the head S1 of a user to extend through to aid the styling thereof. The third guide first rail 25*c* has a shape and length to enable the upper side thereof to nest against a first side of the lower surface of the band horizontal portion 12*b* when removably and adjustably attached thereto. In the exemplary embodiment, the plurality of tines is a parallel top-to-bottom direction.

A third guide second portion 24*d* is horizontally adjustable to the band 11 and conformed to preferably fully cover over and generally conform to the shape of a second side of the head S2 of a user and to terminate at the bottom of the second side of the head S2 of a user preferably farther down from the termination of a second side of the hair H. The second side of the hair H is illustrated herein as the right side. The third guide second portion 24*d* comprises a plurality of tines preferably equidistantly spaced apart from each other and extending away from a third guide second rail 25*d* parallel to each other, although other patterns are envisioned. The spacing of the tines is configured to enable portions of the second side of the hair H of the second side of the head S2 of a user to extend through to aid the styling thereof. The third guide second rail 25*d* has a shape and length to enable the upper side thereof to nest against a second side of the lower surface of the band horizontal portion 12*b* when removably and adjustably attached thereto. In the exemplary embodiment, the plurality of tines is a parallel top-to-bottom direction.

In a preferred embodiment, the combined circumferential width of the second guide first portion 24*a*, second guide second portion 24*b*, third guide first portion 24*c*, third guide second portion 24*d* is coextensive with the circumferential width of the band horizontal portion 12*b*. The plurality of tines of each the second guide first portion 24*a*, second guide second portion 24*b*, third guide first portion 24*c*, third guide second portion 24*d* can follow conventional patterns to accommodate different stylings of the hair H of the back of the head B, first side of the head S1, and second side of the head S2. Also, the second guide first portion 24*a*, second guide second portion 24*b*, third guide first portion 24*c*, third guide second portion 24*d* can be shaped as necessary to not cover the ear, or cover portions of the ear, or fully cover the ear, as desired. In a preferred method of use, hair H extending beyond the terminal edges of the plurality of tines identifies hair H that is to be trimmed according to the desired shape of the template 10.

In some embodiments, a chin strap 40 is provided to add more stability to template 10. Such a chin strap 40 has a first distal end that can be attached to some of the terminal ends of the tines of the third guide first portion 24*c* and a second distal end that can be attached to some of the terminal ends of the tines of the third guide second portion 24*d*. In certain embodiments, the chin strap 40 can be elastic or rigid. In some other embodiments, a mechanism may be provided with the chin strap 40 to facilitate tightening of the band 11 relative to head H either independent of or in concert with, any adjustment mechanism present on the front strap 12*c*, such as a buckle strap, tri-glide adjuster, hook-and-loop-type fasteners, or the like.

Again looking more closely to FIGS. 7 and 8, there is illustrated a more detailed view of the removable connection of the second guide first portion 24*a*, second guide second portion 24*b*, third guide first portion 24*c*, and third guide second portion 24*d* each independently to the band 11. Each of the second guide first portion 24*a*, second guide second portion 24*b*, third guide first portion 24*c*, and third guide second portion 24*d* has at least one (1) lower extender 18, each formed on an upper surface thereof (i.e., the surface facing the lower surface of the band horizontal portion 12*b*) and extending either partially or coextensively with the width thereof. On the lower surface of the band horizontal portion 12*b* (i.e., the surface facing the upper surfaces of the second guide first rail 25*a*, second guide second rail 25*b*, third guide first rail 25*c*, and third guide second rail 25*d*) is a plurality of lower tracks 15, each formed therewithin and extends either partially or coextensively with the width thereof. The number of the lower tracks 15 shall equal or exceed the number of the lower extenders 18. The shape of the lower tracks 15 shall match the shape of the lower extenders 18 so that the lower extenders 18, and thus the second guide first portion 24*a*, second guide second portion 24*b*, third guide first portion 24*c*, and third guide second portion 24*d* themselves, can be independently horizontally motioned therewithin to enable horizontal adjustment to the band 11 via the band horizontal portion 12*b*.

It is also envisioned that other embodiments may fall under the scope of the present invention, such as embodiments where the lower tracks 15 are on the band horizontal portion 12*b* and the lower extenders 18 are on the second guide first rail 25*a*, second guide second rail 25*b*, third guide first rail 25*c*, and third guide second rail 25. In the exemplary embodiment, the number of lower tracks 15 and lower extenders 18 is four (4), where there is one (1) each on the second guide first rail 25*a*, second guide second rail 25*b*, third guide first rail 25, and third guide second rail 25*d*. It is appreciated that there could be more than one (1) lower track 15/lower extender 18 pairs. In some embodiments, the second guide first portion 24*a*, second guide second portion 24*b*, third guide first portion 24*c*, and third guide second portion 24*d* may be integrally connected with the band 11 or otherwise removably connected via a friction fit, pressure fit, mating engagement, dovetail connection, clips, barbs, tongue-in-groove, threaded, magnetic and/or key/keyslot. It is preferred that the final resting place of a desired horizontal position of each of the second guide first portion 24*a*, second guide second portion 24*b*, third guide first portion 24*c*, and third guide second portion 24*d* relative to the band 11 is secure. Resting stops to further enhance the security of the desired horizontal position can be envisioned to be used with the present invention.

In use, the first guide 22, second guide first portion 24*a*, second guide second portion 24*b*, third guide first portion 214*c*, and third guide second portion 24*d* are independently adjusted relative the band 11 to a desired length and hair H height and style. The band 11 is positioned about the head B, F, T, S1, S2 and adjusted to resist and/or prevent movement of template 10 and increase precision during the haircutting process. The hair H is styled straight down at the back and sides of the head B, S1, S2 and to the front at the top of the head T. The opposite motions are performed by brushing or combing the hair H on the back and sides of the head B, S1, S2 upwards and the hair H on the top of the head T backwards. A cutting tool is utilized to trim the hair H that extends away from the first guide 22, second guide first portion 24*a*, second guide second portion 24*b*, third guide first portion 24*c*, and third guide second portion 24*d*. This is repeated until the hair H has reached the desired length. The template 10 is removed and any excess hair H around the ear is trimmed to the desired length. The template 10 allows for a consistent haircut when using the template 10 for haircuts.

It is appreciated that although the exemplary embodiment describes a template 10 that includes five (5) distinct guides (i.e. one (1) first guide 22, one (1) second guide first portion 24*a*, one (1) second guide second portion 24*b*, one (1) third guide first portion 24*c*, and one (1) third guide second portion 24*d*) other sizes, shapes, and numbers of discrete movable portions can be construed as falling under the overall scope of the invention in order to provide different styles of desired styling of hair H.

While various aspects of the present invention have been described in the above disclosure, the description of this disclosure is intended to illustrate and not limit the scope of the invention. The invention is defined by the scope of the claims of a corresponding nonprovisional utility patent application and not the illustrations and examples provided in the above disclosure. Skilled artisans will appreciate additional aspects of the invention, which may be realized in alternative embodiments, after having the benefit of the above disclosure. Other aspects, advantages, embodiments, and modifications are within the scope of the claims of a corresponding nonprovisional utility patent application.

The invention claimed is:

1. A haircutting template, comprising:

a band configured for disposal about a head of a user, the band includes a band vertical portion, a band horizontal portion, and a front strap, the band is adjustable to fit a plurality of different sized heads of the user and the band horizontal portion extends perpendicularly from the band vertical portion;

a first guide vertically adjusted to the band, the first guide is conformed to fully cover over and generally conform to the shape of a top of the head of the user and to terminate on a forehead of the user either directly on the front strap or over farther downward relative to the front strap, the first guide includes a plurality of tines equidistantly spaced apart from each other and extending away from a first guide rail parallel to each other to enable portions of a plurality of hair of the top of the head of the user to extend through to aid styling thereof;

a second guide first portion horizontally adjusted to the band and conformed to fully cover over and conform to a first portion of the back of the head of the user and to terminate at the bottom of the back of the head of the user farther down from the termination of a first back portion of the hair, the second guide first portion includes a plurality of tines equidistantly spaced apart from each other and extending away from a second guide first rail parallel to each other to enable portions of the first back portion of the hair of the back of the head of the user to extend through to aid the styling thereof;

a second guide second portion horizontally adjusted to the band and conformed to fully cover over and conform to a second portion of the back of the head of the user and to terminate at the bottom of the back of the head of the user farther down from the termination of a second back portion of the hair, the second guide second portion includes a plurality of tines equidistantly spaced apart from each other and extending away from a second guide second rail parallel to each other to enable portions of the second back portion of the hair of the back of the head of the user to extend through to aid the styling thereof;

a third guide first portion horizontally adjusted to the band and conformed to fully cover over and conform to a first side of the head of the user and to terminate at the bottom of the first side of the head of the user farther down from the termination of a first side of the hair, the third guide first portion includes a plurality of tines equidistantly spaced apart from each other and extending away from a third guide first rail to enable portions of the first side of the hair of the first side of the head of the user to extend through to aid the styling thereof;

a third guide second portion horizontally adjusted to the band and conformed to fully cover over and generally conform to a second side of the head of the user and to terminate at the bottom of the second side of the head of the user farther down from the termination of a second side of the hair, the third guide second portion includes a plurality of tines equidistantly spaced apart from each other and extending away from a third guide second rail to enable portions of the second side of the hair of the second side of the head of the user to extend through to aid the styling thereof; and a chin strap having a first distal end that is attached to some of the terminal ends of the tines of the third guide first portion and a second distal end that is attached to some of the terminal ends of the tines of the third guide second portion;

wherein the first guide rail has a shape and length to enable the inner side thereof to nest against the inner surface of the band vertical portion when removably and adjustably attached thereto; and wherein the first guide rail has at least one upper extender, each formed on an inner surface thereof and extending either partially or coextensively with a width thereof.

2. The haircutting template, according to claim 1, wherein the band vertical portion has an inner side shaped to generally conform to the back of the head of the user.

3. The haircutting template, according to claim 1, wherein the band horizontal portion includes a front edge that coextensively extends horizontally away from a bottom edge of the band vertical portion.

4. The haircutting template, according to claim 1, wherein the band horizontal portion extends past a plurality of hair from the back of the head of the user to permit styling thereof.

5. The haircutting template, according to claim 1, wherein the band is made out of a material from the group consisting of resilient, washable, and stainless subjected to heat and one or more chemicals associated with haircare.

6. The haircutting template, according to claim 1, wherein the front strap conformably secures the haircutting template about the forehead of the user in order to separate the haircutting template into a plurality of upper areas to aid in styling the top of the head of the user from the lower areas to aid in styling the back of the head of the user, the first side of the head of the user, and the second side of the head of the user.

7. The haircutting template, according to claim 1, wherein the front strap includes a plurality of strap fasteners located adjacent to a pair of distal ends thereof.

8. The haircutting template, according to claim 7, wherein the strap fasteners are removably attached to a plurality of complementary fasteners located on a plurality of outer surfaces of the distal ends of the band vertical portion.

9. The haircutting template, according to claim 7, wherein the strap fasteners are selected from the group consisting of a plurality of permanent strap fasteners, a plurality of like rivets, a plurality of removable strap fasteners, a plurality of snaps, or a plurality of magnets.

10. The haircutting template, according to claim 7, wherein the front strap is elastic or rigid to provide manual adjustment to determine conformity to the forehead of the user.

11. The haircutting template, according to claim 7, wherein the front strap includes an adjustment mechanism.

12. The haircutting template, according to claim 7, wherein the front strap is affixed or partially encased within the band vertical portion.

13. The haircutting template, according to claim 1, wherein the second guide first rail enables the upper side thereof to nest against a first back portion of the lower surface of the band horizontal portion when removably and adjustably attached thereto.

14. The haircutting template, according to claim 13, wherein the second guide first rail has a shape and length to enable the upper side thereof to nest against the first back portion of the lower surface of the band horizontal portion when removably and adjustably attached thereto.

15. The haircutting template, according to claim 1, wherein the second guide second rail has a shape and length to enable the upper side thereof to nest against a second back portion of the lower surface of the band horizontal portion when removably and adjustably attached thereto.

16. The haircutting template, according to claim 1, wherein the third guide first rail has a shape and length to enable the upper side thereof to nest against a first side of the lower surface of the band horizontal portion when removably and adjustably attached thereto.

17. The haircutting template, according to claim 1, wherein the third guide second rail has to enable the upper side thereof to nest against a second side of the lower surface of the band horizontal portion when removably and adjustably attached thereto.

18. The haircutting template, according to claim 1, wherein the surface facing the upper surfaces of the second guide first rail, the second guide second rail, the third guide first rail, and the third guide second rail includes a plurality of lower tracks, each formed therewithin and extends either partially or coextensively with the width thereof.

* * * * *